US009810239B2

(12) United States Patent
Hayamitsu

(10) Patent No.: US 9,810,239 B2
(45) Date of Patent: Nov. 7, 2017

(54) ELECTRIC BLOWER

(71) Applicant: Nidec Corporation, Kyoto (JP)

(72) Inventor: Ryosuke Hayamitsu, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 233 days.

(21) Appl. No.: 14/747,307

(22) Filed: Jun. 23, 2015

(65) Prior Publication Data

US 2016/0032938 A1 Feb. 4, 2016

(30) Foreign Application Priority Data

Jul. 31, 2014 (JP) ..... 2014-156607

(51) Int. Cl.

| | |
|---|---|
| ***F04D 29/44*** | (2006.01) |
| ***F04D 29/42*** | (2006.01) |
| ***A47L 5/22*** | (2006.01) |
| ***F04D 17/16*** | (2006.01) |
| ***F04D 25/08*** | (2006.01) |
| ***F04D 29/66*** | (2006.01) |
| ***F04D 17/08*** | (2006.01) |
| ***F04D 25/06*** | (2006.01) |
| ***F04D 29/28*** | (2006.01) |
| ***F04D 29/30*** | (2006.01) |

(52) U.S. Cl.

CPC ..... *F04D 29/4253* (2013.01); *A47L 5/22* (2013.01); *F04D 17/08* (2013.01); *F04D 17/165* (2013.01); *F04D 25/06* (2013.01); *F04D 25/082* (2013.01); *F04D 29/281* (2013.01); *F04D 29/30* (2013.01); *F04D 29/4206* (2013.01); *F04D 29/444* (2013.01); *F04D 29/667* (2013.01)

(58) Field of Classification Search

CPC .... F04D 17/16; F04D 17/165; F04D 25/0606; F04D 25/082; F04D 29/4253; F04D 29/444; F04D 29/03

See application file for complete search history.

(56) References Cited

U.S. PATENT DOCUMENTS

| | | | | |
|---|---|---|---|---|
| 2,915,237 | A * | 12/1959 | Galiulo | F04D 17/164 417/234 |
| 2006/0280596 | A1 | 12/2006 | Kim et al. | |
| 2007/0278876 | A1 | 12/2007 | Haga et al. | |
| 2014/0147311 | A1 | 5/2014 | Jung et al. | |

FOREIGN PATENT DOCUMENTS

| | | | |
|---|---|---|---|
| DE | 297 17 906 | U1 | 2/1999 |
| JP | 60-122298 | A | 6/1985 |
| JP | 61-252896 | A | 11/1986 |
| JP | 2010-190136 | A | 9/2010 |

* cited by examiner

*Primary Examiner* — Ninh H Nguyen

(74) *Attorney, Agent, or Firm* — Keating & Bennett, LLP

(57) ABSTRACT

An electric blower includes a centrifugal impeller, a diffuser including stationary vanes on a discharge side of the centrifugal impeller, a motor configured to drive the centrifugal impeller, a fan case configured to cover the centrifugal impeller and the diffuser, a housing case joined to the fan case, and return guide vanes that guide air which has been guided by the stationary vanes to an inner surface of the fan case radially inward through a space under the diffuser. The housing case includes an annular lower plate portion located axially below the diffuser. Each return guide vane is continuous with an upper surface of the annular lower plate portion. An upper end of each return guide vane is located axially opposite to the diffuser.

12 Claims, 6 Drawing Sheets

ELECTRIC BLOWER

BACKGROUND OF THE INVENTION

1. Field of the Invention

The present invention relates to an electric blower including a diffuser.

2. Description of the Related Art

JP-A 2010-190136, for example, describes an electric blower for use in an electric vacuum cleaner. In this known electric blower, an air flow discharged from a centrifugal impeller rotating at a high speed passes through a diffuser channel portion defined by a plurality of stationary vanes arranged in a spiral pattern, a diffuser base, and an inner wall of a fan case, which gradually increases in a channel area as it approaches an air outlet, and then, the air flow changes its direction to travel in an axial direction toward the air outlet, and passes through an outer channel portion along an inner wall of a housing case. Further, the air flow is guided by return guide vanes arranged below the diffuser to pass through a return channel portion inside the inner wall of the housing case, and is finally discharged out of the electric blower through the air outlet of the housing case.

In the electric blower described in JP-A 2010-190136, the return guide vanes, which together define the return channel portion, are integrally defined with a lower surface of the diffuser, which includes the stationary vanes arranged in the spiral pattern at an outer circumferential portion of the diffuser base.

In the electric blower described above, an air flow travelling radially outward and produced by the centrifugal impeller is guided by the stationary vanes of the diffuser, and is caused by the stationary vanes to change its direction to travel in a circumferential direction. Then, the air flow is turned 180 degrees by the inner wall of the housing case to enter into a space between the housing case and the diffuser. At this time, under the diffuser, the air flow, caused by the inner wall of the housing case to change its direction, travels along the inner surface of the housing case. In the known electric blower, the return guide vanes are integrally defined with the lower surface of the diffuser, and gaps are defined between the return guide vanes and the inner surface of the housing case because of tolerances. Accordingly, a portion of the air flow guided to the space under the diffuser enters into such a gap, so that the air flow is not smoothly guided, and a loss occurs. In addition, noise may occur as a result of air entering into such a gap.

SUMMARY OF THE INVENTION

An electric blower according to a preferred embodiment of the present invention includes a centrifugal impeller configured to rotate about a central axis extending in a vertical direction; a diffuser including a plurality of stationary vanes located on a discharge side of the centrifugal impeller; a motor configured to drive the centrifugal impeller; a fan case configured to cover the centrifugal impeller and the diffuser, and including an inlet port located axially opposite to a central portion of an upper surface of the centrifugal impeller; a housing case located radially outside of the motor, and joined to the fan case; and a plurality of return guide vanes each of which is configured to guide air which has been guided by each stationary vane of the diffuser to an inner surface of the fan case radially inward through a space under the diffuser. The housing case includes an annular lower plate portion located axially below the diffuser. Each return guide vane is continuous with an upper surface of the annular lower plate portion. An upper end of each return guide vane is located axially opposite to the diffuser.

According to a preferred embodiment of the present invention, the plurality of return guide vanes, which are located in the space under the diffuser, are configured to stand continuously with the annular lower plate portion of the housing case, and accordingly, no gaps are defined between the housing case and the return guide vanes. An air flow travelling radially outward and produced by the centrifugal impeller is guided by the stationary vanes of the diffuser, then enters from the inner surface of the fan case into the space under the diffuser, and travels along the annular lower plate portion of the housing case. This air flow is guided by the return guide vanes toward an inner circumference of the housing case. Because no gaps are defined between the housing case and the return guide vanes, a loss in the air flow and noise are reduced when compared to related art.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, electric blowers according to preferred embodiments of the present invention will be described with reference to the accompanying drawings. It is assumed herein that a direction parallel or substantially parallel to a central axis of the electric blower is referred to by the term "axial direction", "axial", or "axially", that directions perpendicular or substantially perpendicular to the central axis of the electric blower are each referred to by the term "radial direction", "radial", or "radially", and that a direction along a circular arc centered on the central axis of the electric blower is referred to by the term "circumferential direction", "circumferential", or "circumferentially". It is also assumed herein that an axial direction is a vertical direction, and that a side on which a centrifugal impeller is arranged with respect to a motor is defined as an upper side. The shape of each member or portion and relative positions of different members or portions will be described based on the above assumptions. It should be noted, however, that the above definitions of the vertical direction and the upper side are not meant to restrict in any way the orientation of an electric blower according to any preferred embodiment of the present invention when in use.

Figure 1:
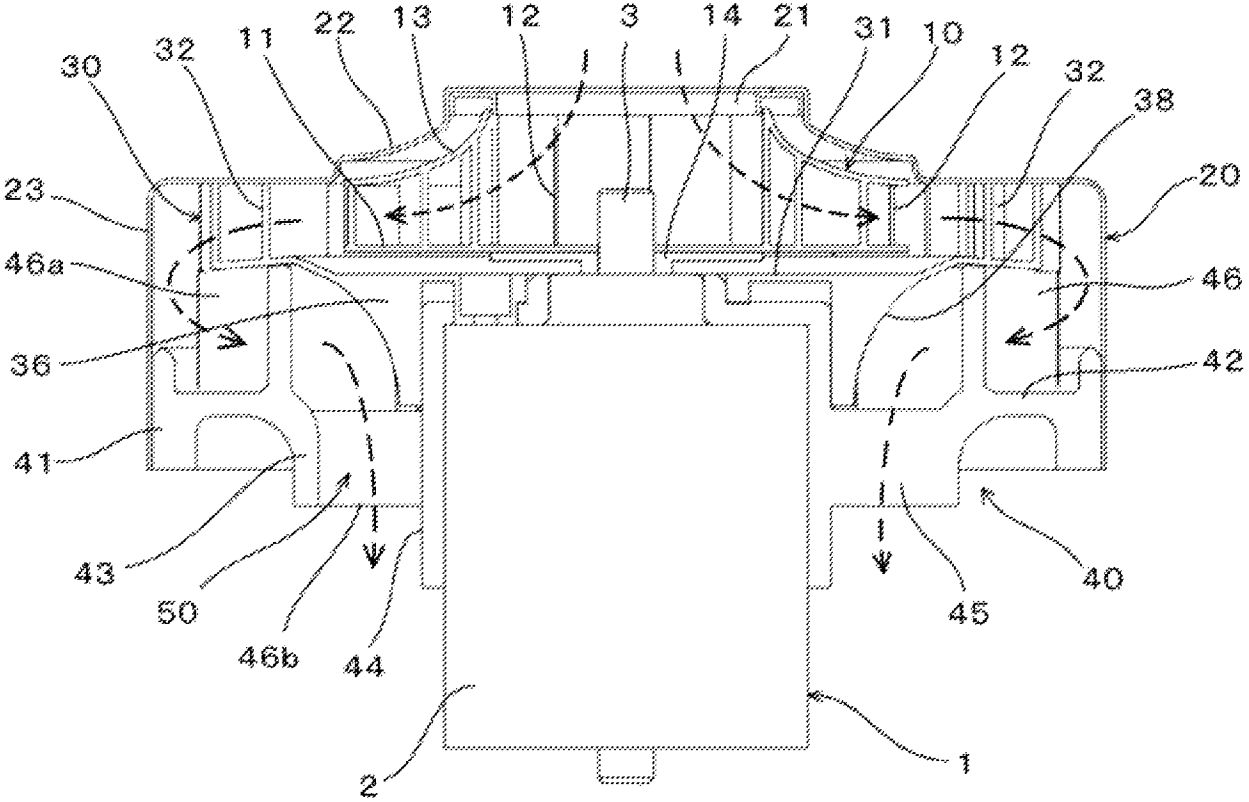
FIG. 1 is a cross-sectional view of an electric blower according to a preferred embodiment of the present invention.

FIG. 1 is a cross-sectional view illustrating an overall structure of an electric blower according to a preferred embodiment of the present invention. A motor 1, which is provided in a central portion of the electric blower, is covered with a bracket 2 made of, for example, a metal, and a centrifugal impeller 10 is attached to a rotating shaft 3, which includes a portion extending above the bracket 2. The motor 1 is configured to drive the centrifugal impeller 10. Specifically, the centrifugal impeller 10 preferably includes a base plate 11, which is defined by a circular flat plate, and a plurality of rotor blades 12 provided in a circumferential direction on an upper surface of the base plate 11. Upper ends of the rotor blades 12 are joined to one another by a shroud 13 preferably including a curved conical surface which includes a central opening. A fastener 14, which is fixed to a central portion of a rear surface of the base plate 11, is used to attach the centrifugal impeller 10 to the rotating shaft 3 of the motor 1. The centrifugal impeller 10 is configured to rotate about a central axis extending in a vertical direction. Once the motor 1 is driven, the centrifugal impeller 10 starts rotating together with the rotating shaft 3, and rotation of each rotor blade 12 causes air in the vicinity of the rotor blade 12 to be pushed radially outward, resulting in a negative pressure being produced at a radially inner portion of the rotor blade 12, which causes outside air to be suctioned in through the central opening of the shroud 13, and produces air flows as represented by broken line arrows in FIG. 1. The centrifugal impeller 10 is caused by the motor 1 to preferably rotate in, for example, a counterclockwise direction in a plan view.

The centrifugal impeller 10 and a diffuser 30, which will be described in greater detail below, are together covered with a fan case 20. The fan case 20 includes an inlet port 21 which matches the central opening of the centrifugal impeller 10, and the centrifugal impeller 10 causes outside air to be suctioned in through the inlet port 21. That is, the fan case 20 is configured to cover the centrifugal impeller 10 and the diffuser 30, and includes the inlet port 21, which is located axially opposite to a central portion of an upper surface of the centrifugal impeller 10. The fan case 20 is preferably defined by, for example, subjecting a metal sheet to press forming, and is provided in or substantially in the shape of an upside-down cup. The fan case 20 preferably includes a top plate portion 22, in which the inlet port 21 is defined, and a cylindrical wall portion 23 joined to an outer circumference of the top plate portion 22. Referring to FIG. 1, a portion of the top plate portion 22 which surrounds the inlet port 21 preferably includes a curved conical surface so as to match the shape of the shroud 13 of the centrifugal impeller 10, while a portion of the top plate portion 22 which is radially outward of the centrifugal impeller 10 preferably has a flat plate shape.

Figure 2:
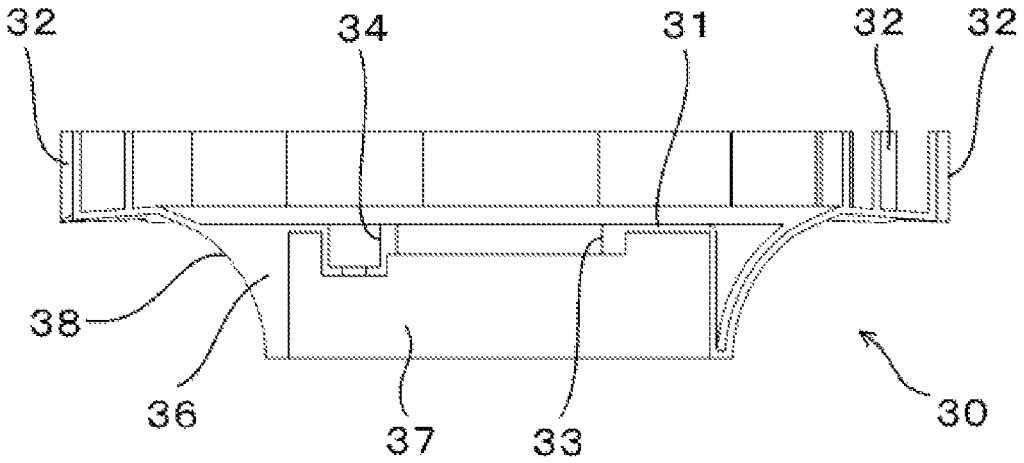
FIG. 2 is a cross-sectional view of a diffuser according to a preferred embodiment of the present invention illustrated in FIG. 1.
Figure 3:
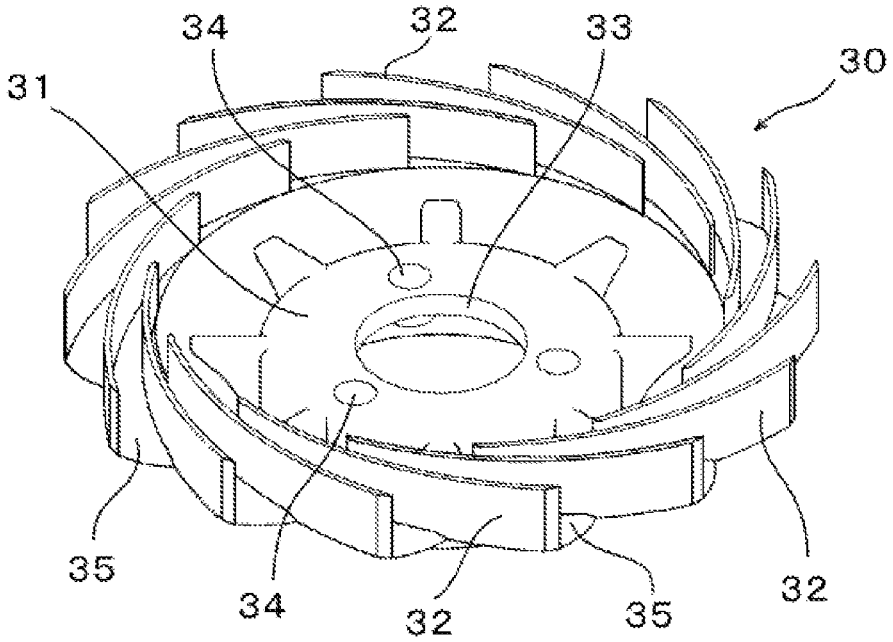
FIG. 3 is a perspective view of the diffuser according to a preferred embodiment of the present invention illustrated in FIG. 1.

Inside the fan case 20, the diffuser 30 is preferably configured to cover a lower surface and an outer circumferential portion of the centrifugal impeller 10. Referring to FIGS. 2 and 3, the diffuser 30 includes a plurality of stationary vanes 32 provided on a discharge side of the centrifugal impeller 10. More specifically, the diffuser 30 preferably includes a circular base portion 31 configured to cover the lower surface of the centrifugal impeller 10, and the plurality of stationary vanes 32, which are provided in a spiral pattern radially outside of the centrifugal impeller 10, i.e., on the discharge side of the centrifugal impeller 10. The stationary vanes 32 are integrally defined with an outer circumference of the circular base portion 31, preferably with the stationary vanes 32 and the circular base portion 31 being defined as portions of a single monolithic unitary member. The circular base portion 31 preferably includes a central opening portion 33, recessed portions 34 to accommodate screws, and so on, for example, to attach the diffuser 30 to the motor 1.

The stationary vanes 32 extend from an outer circumferential portion of the circular base portion 31 radially outward and in the counterclockwise direction, and a gap between adjacent ones of the stationary vanes 32 gradually increases in width as the gap extends radially outward, to cause air discharged from the centrifugal impeller 10 to flow along an inner surface of the cylindrical wall portion 23 of the fan case 20. A bottom plate portion 35, which is continuous with the circular base portion 31, is configured to close a space between lower ends of adjacent ones of the stationary vanes 32. An upper end of each stationary vane 32 of the diffuser 30 is in contact with a lower surface of the portion of the top plate portion 22 of the fan case 20 which is defined in the shape of a flat plate. As a result, a diffuser channel portion is defined by adjacent ones of the stationary vanes 32, the bottom plate portion 35, and the top plate portion 22, so that air is guided from the centrifugal impeller 10 toward an inside of the cylindrical wall portion 23 of the fan case 20.

The diffuser 30 preferably further includes an annular inner wall portion 36 integrally defined with the circular base portion 31 of the diffuser 30. A fitting recessed portion 37, to which an upper portion of a motor holder portion described below is fitted, is defined inside of the annular inner wall portion 36. The fitting recessed portion 37 is in communication with the central opening portion 33. An outer circumferential surface of the annular inner wall portion 36 includes a curved circumferential surface 38 that decreases in diameter with decreasing height.

Figure 4:
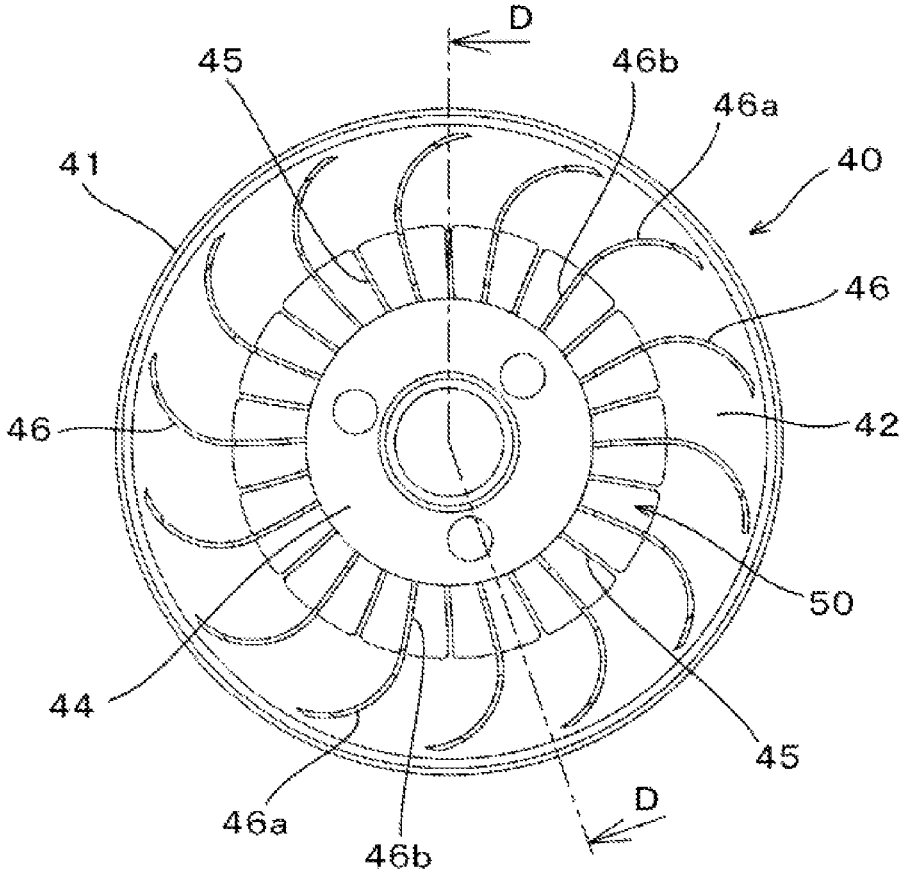
FIG. 4 is a plan view of a housing case according to a preferred embodiment of the present invention illustrated in FIG. 1.
Figure 5:
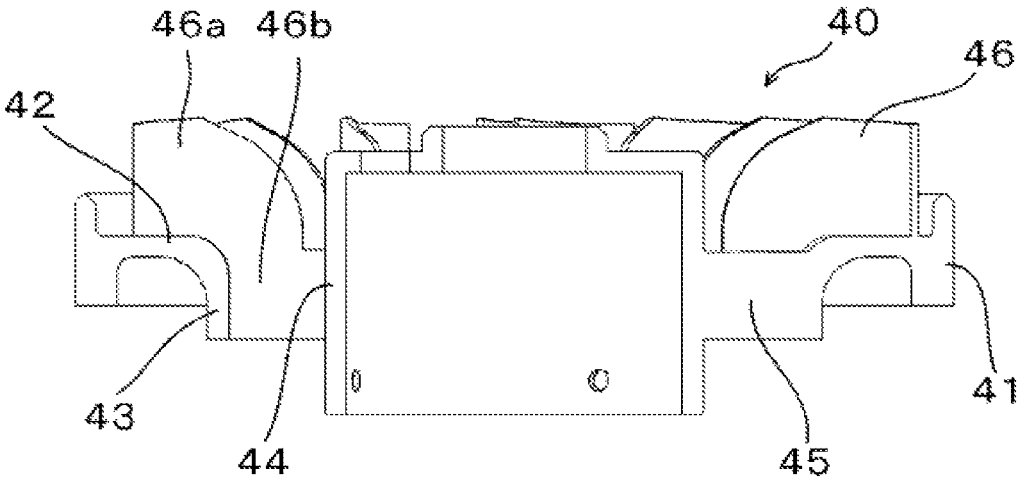
FIG. 5 is a cross-sectional view of the housing case taken along line D-D in FIG. 4.
Figure 6:
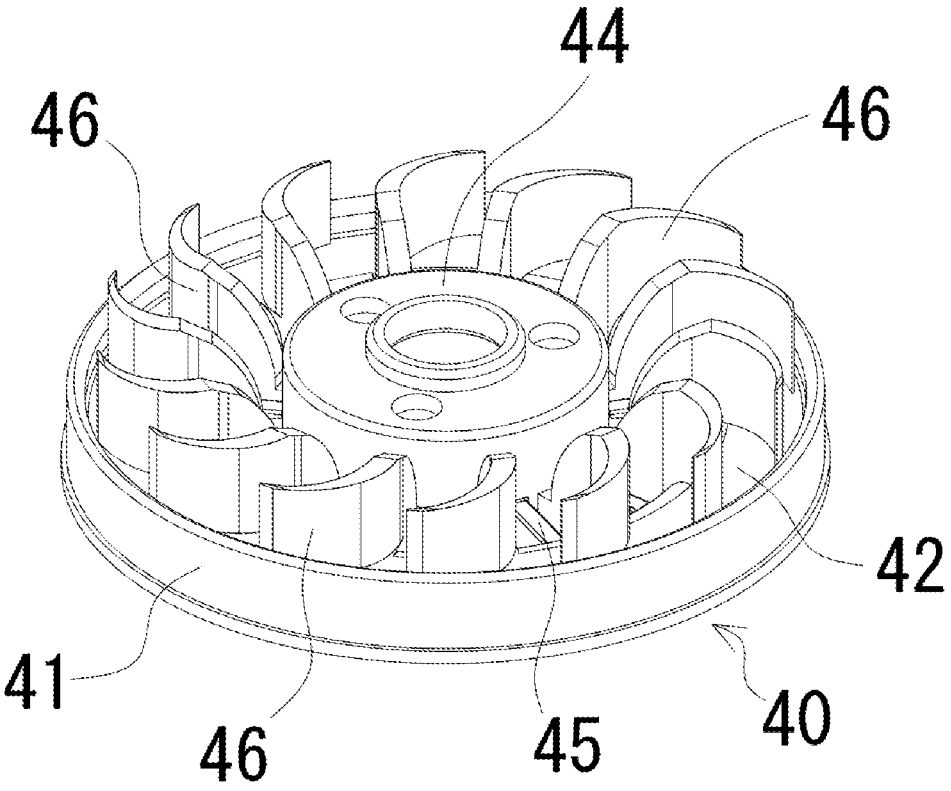
FIG. 6 is a perspective view of the housing case according to a preferred embodiment of the present invention illustrated in FIG. 1.

A housing case 40 is provided on an outer circumference of the motor 1. The housing case 40 is joined to the fan case 20, and is located radially outside of the motor 1. The housing case 40 includes a cylindrical outer circumferential wall portion 41 fitted to an inside of a lower portion of the cylindrical wall portion 23 of the fan case 20, and screws, for example, are preferably used to fix the motor 1 and the housing case 40 to each other. The housing case 40 preferably is a resin-molded article, and has a structure as illustrated in FIGS. 4, 5, and 6. The housing case 40 preferably includes an annular lower plate portion 42 located axially below the diffuser 30. A plurality of return guide vanes 46 each of which is continuous with the annular lower plate portion 42 are provided on an upper surface of the annular lower plate portion 42. An upper end of each return guide vane 46 is located axially opposite to the diffuser 30. The above structure contributes to reducing a loss in an air flow passing inside the housing case 40 and also to reducing noise.

The housing case 40 preferably includes the annular lower plate portion 42, a tubular portion 43, a motor holder portion 44, a plurality of flow control vanes 45, and the plurality of return guide vanes 46. The annular lower plate portion 42 is annular, and extends radially inward from an axial middle of an inside of the outer circumferential wall portion 41. The tubular portion 43 is continuous with an inner circumferential portion of the annular lower plate portion 42, and extends axially downward therefrom. The motor holder portion 44 is in the shape of a cap, and is configured to cover an upper half portion of the outer circumference of the motor 1 and an upper surface of the motor 1. The flow control vanes 45 are provided in a radial manner between the tubular portion 43 and an outer circumferential wall portion (which defines an annular portion) of the motor holder portion 44 to join the tubular portion 43 and the outer circumferential wall portion of the motor holder portion 44 to each other. Each of the return guide vanes 46 extends continuously over the upper surface of the annular lower plate portion 42 and an inner surface of the tubular portion 43. The annular portion is configured to join the return guide vanes 46 to one another at inner ends of the return guide vanes 46. This structure enables each return guide vane 46 to be securely fixed.

The tubular portion 43 is located at the inner circumferential portion of the annular lower plate portion 42 of the housing case 40 to define an exhaust passage 50 between the tubular portion 43 and an outside of the motor 1. In addition, each return guide vane 46 includes a portion extending between an inner circumferential surface of the tubular portion 43 and the outside of the motor 1. If each return guide vane 46 were configured to end in a space under the diffuser 30, an air flow which is guided by the return guide vane 46 toward an inner circumference of the housing case 40 would become unstable at the tubular portion 43, which may result in turbulence. However, the above-described structure, in which each return guide vane extends continuously up to a space between the inner circumferential surface of the tubular portion 43 and the outside of the motor 1, contributes to stabilizing and enhancing the air flow, leading to a further improvement in efficiency.

A junction of the annular lower plate portion 42 and the tubular portion 43 of the housing case 40 includes a smoothly curved inner surface. This makes an air flow passing from the annular lower plate portion 42 to the tubular portion 43 smoother. In addition, the exhaust passage 50, which extends in an axial direction, is preferably defined between the tubular portion 43 and the outer circumferential wall portion of the motor holder portion 44 of the housing case 40.

Referring to FIGS. 4 and 5, an inner circumferential portion of each of the plurality of return guide vanes 46 extends up to a position radially inward of an inner end of the annular lower plate portion 42. That is, each of the plurality of return guide vanes 46 includes a curved vane portion 46*a* that is continuous with the upper surface of the annular lower plate portion 42, and a flow control vane portion 46*b* extending from an inner end of the curved vane portion 46*a* radially inward and into a space between the tubular portion 43 and the outer circumferential wall portion of the motor holder portion 44. The flow control vane portions 46*b* are arranged in a radial manner. The above arrangement contributes to reducing turbulence in an air flow guided by each return guide vane 46 toward the inner circumference of the housing case 40, and further improving efficiency of the electric blower.

Each return guide vane 46 is configured to bend in the circumferential direction at least above the annular lower plate portion 42. That is, the curved vane portion 46*a* of each return guide vane 46 is configured to bend in a clockwise direction above the annular lower plate portion 42 as it extends radially outward. An air flow swirling in the counterclockwise direction as discharged by each stationary vane 32 of the diffuser 30 is received by the curved vane portion 46*a*, and the curved surface of the curved vane portion 46*a* guides the air flow radially inward. This structure enables the air flow to be guided from the diffuser 30 into the space radially inside of the tubular portion 43 without allowing a great resistance to occur when the air flow is guided from an inner surface of the fan case 20 to the return guide vane 46.

An upper edge of each curved vane portion 46*a* is positioned opposite to a lower surface of an outer circumferential portion of the diffuser 30, that is, a lower surface of the bottom plate portion 35, and the upper edge of the curved vane portion 46*a* and the lower surface of the outer circumferential portion of the diffuser 30 are preferably, for example, in contact with each other. The flow control vanes 45 are positioned between the inner circumferential surface of the tubular portion 43 and an outer circumferential surface of the motor 1 such that each flow control vane 45 is positioned between adjacent ones of the return guide vanes 46. The flow control vane portion 46*b* of each return guide vane 46 is positioned between adjacent ones of the flow control vanes 45 in the space between the tubular portion 43 and the motor holder portion 44, and the flow control vane portions 46*b* and the flow control vanes 45 together join the tubular portion 43 and the motor holder portion 44 to each other. This structure preferably makes it possible to control the air flow which has been guided by each return guide vane 46 into the space radially inside of the tubular portion 43, and smoothly guide the air toward an outlet side.

The electric blower having the above-described structure is preferably assembled according to the following procedure. That is, the motor 1 is fitted to the motor holder portion 44 of the housing case 40 through a lower opening of the motor holder portion 44, while the upper portion of the motor holder portion 44 is fitted to the fitting recessed portion 37 of the annular inner wall portion 36 of the diffuser 30 arranged above the housing case 40. Screws, for example, are preferably used to combine the motor 1, the housing case 40, and the diffuser 30 into a single unit. Next, the centrifugal impeller 10 is attached to the rotating shaft 3 of the motor 1, the rotating shaft 3 including a portion projecting above the circular base portion 31 of the diffuser 30. Further, the fan case 20 is attached so as to cover the centrifugal impeller 10, the diffuser 30, and the housing case 40.

In the electric blower having the above-described structure, air which has been guided from the stationary vanes 32 of the diffuser 30 to the inner surface of the fan case 20 is guided by the plurality of return guide vanes 46 radially inward through the space under the diffuser 30. That is, once the motor 1 is driven, the centrifugal impeller 10 starts rotating, and the outside air is taken in through the inlet port 21 of the fan case 20, is discharged radially outward through the centrifugal impeller 10, and is guided toward the inner surface of the cylindrical wall portion 23 of the fan case 20 while generating an air flow swirling in the counterclockwise direction through the stationary vanes 32 of the diffuser 30 provided in the spiral pattern. Further, the swirling air flow from the diffuser 30 is pushed downward along the inner surface of the cylindrical wall portion 23, undergoes a change of direction so as to be guided to the annular lower plate portion 42 of the housing case 40 to travel under the diffuser 30, and is guided radially inward between the upper surface of the annular lower plate portion 42 and a lower surface of the diffuser 30. That is, after being guided to the annular lower plate portion 42, the swirling air flow first changes into a radial air flow by passing the curved vane portion 46*a* of each return guide vane 46, and is then guided to the exhaust passage 50 by the flow control vane portion 46*b* of the return guide vane 46.

Here, the air flow sent from the diffuser 30 strikes a surface of the annular lower plate portion 42 of the housing case 40 because of momentum of the flow. However, since the return guide vanes 46, which are located axially below the diffuser 30, are continuous with the upper surface of the annular lower plate portion 42, a loss due to air entering into a gap is reduced when compared to the case of a known structure in which gaps are defined between the return guide vanes and the annular lower plate portion, and efficient guiding of the air flow can be accomplished.

In addition, because the flow control vane portion 46*b* of each return guide vane 46 extends up to a position of the annular inner wall portion 36 of the diffuser 30, an air flow is smoothly guided radially inward without undergoing a disturbance along the way, and this air flow is smoothly guided to the exhaust passage 50 by the curved circumferential surface 38 of the annular inner wall portion 36 of the diffuser 30. That is, the diffuser 30 includes the annular inner wall portion 36 located radially inside of the return guide vanes 46, and including the curved circumferential surface 38 configured to guide, to the exhaust passage 50, air which has been guided radially inward by each return guide vane 46. This structure enables the air flow to more smoothly pass to the exhaust passage 50, thus further improving the efficiency of the electric blower. In addition, the flow control vane portion 46*b* of each return guide vane 46 is configured to continuously extend up to a position of a lower end of the exhaust passage 50, and this, in combination with the flow control vanes 45 in the exhaust passage 50, enables smooth guiding of the air flow without causing a stagnation or disturbance in the air flow. As described above, an air channel defined by the housing case 40 and the diffuser 30 according to the present preferred embodiment of the present invention includes only a few portions at which a loss can occur, and not only results in only extremely limited noise, but is effective in improving loss reduction, leading to a significant improvement in the efficiency. After the air flow passes through the exhaust passage 40, a portion of the air flow touches a surface of the metallic bracket 2 of the motor 1, and this contributes to cooling the motor 1.

It is desirable that, in the above-described electric blower, the inner circumferential portion of each return guide vane 46 extend up to the position radially inward of the inner end of the annular lower plate portion 42. This prevents an air flow which has been guided by the return guide vane 46 toward the inner circumference of the housing case 40 from becoming disturbed, and leads to an additional improvement in the efficiency.

Further, it is preferable that, in the above-described electric blower, the tubular portion 43, which is configured to define the exhaust passage 50 between the tubular portion 43 and the outside of the motor 1, be provided at the inner circumferential portion of the annular lower plate portion 42 of the housing case 40, and that each return guide vane 46 include a portion extending between the inner circumferential surface of the tubular portion 43 and the outside of the motor 1.

If each return guide vane 46 were configured to end in the space under the diffuser 30, the air flow which is guided by the return guide vane 46 toward the inner circumference of the housing case 40 would become unstable at the tubular portion 43, which might result in turbulence. However, because each return guide vane 46 preferably extends continuously up to the space between the inner circumferential surface of the tubular portion 43 and the outside of the motor 1, the air flow is stabilized and enhanced, leading to a further improvement in the efficiency.

In addition, the junction of the annular lower plate portion 42 and the tubular portion 43 of the housing case 40 preferably includes the smoothly curved inner surface. This makes the air flow passing from the annular lower plate portion 42 to the tubular portion 43 smoother. In addition, each return guide vane 46 is preferably configured to bend in the circumferential direction at least above the annular lower plate portion 42. This enables the air flow to be guided from the diffuser 30 into the space radially inside of the tubular portion 43 without allowing a great resistance to occur when the air flow is guided from the inner surface of the fan case 20 to the return guide vane 46.

In this case, the diffuser 30 preferably includes the annular inner wall portion 36 located radially inside of the return guide vanes 46, and including the curved circumferential surface 38 configured to guide, to the exhaust passage 50, the air which has been guided radially inward by each return guide vane 46. This enables the air flow to more smoothly pass to the exhaust passage 50, thus further improving the efficiency.

Further, the flow control vanes 45, each of which is provided between adjacent ones of the return guide vanes 46, preferably extend in the axial direction between the inner circumferential surface of the tubular portion 43 and the outer circumferential surface of the motor 1. This enables the air flow which has been guided by each return guide vane 46 into the space radially inside of the tubular portion 43 to be controlled to allow the air flow to be smoothly guided toward the outlet side.

According to a preferred embodiment of the present invention, when the air flow produced by the centrifugal impeller passes from the inner surface of the fan case 20 along the annular lower plate portion 42 of the housing case 40 under the diffuser 30 after being guided by each stationary vane 32 of the diffuser 30, the air flow is guided by each return guide vane 46 which is continuous with the annular lower plate portion 42, and this contributes to reducing a loss in the air flow, and contributes to reducing a loss which would occur if gaps were defined between the housing case 40 and the return guide vanes 46 as in related art, leading to an improvement in the efficiency and a reduction in noise.

While preferred embodiments of the present invention has been described above, it will be understood that the present invention is not limited to the above-described preferred embodiments, and that a variety of modifications are possible without departing from the scope of the present invention as claimed below.

Electric blowers according to preferred embodiments of the present invention are suitable for use in, for example, electric vacuum cleaners and the like.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electric blower comprising:

a centrifugal impeller that rotates about a central axis extending in a vertical direction;

a diffuser including a plurality of stationary vanes located on a radially outer side of the centrifugal impeller;

a motor that drives the centrifugal impeller;

a fan case that covers the centrifugal impeller and the diffuser, and including an inlet port located axially opposite to a central portion of an upper surface of the centrifugal impeller;

a housing case located radially outside of the motor, and joined to the fan case; and a plurality of return guide vanes each of which guides air which has been guided by each of the plurality of stationary vanes of the diffuser to an inner surface of the fan case radially inward through a space under the diffuser; wherein the housing case includes an annular lower plate portion located axially below the diffuser;

each of the plurality of return guide vanes is continuous with an upper surface of the annular lower plate portion;

an upper end of each of the plurality of return guide vanes is located axially opposite to the diffuser; and at least a partial portion of each of the plurality of the return guide vanes are axially aligned with the plurality of stationary vanes in the vertical direction.

2. The electric blower according to claim 1, wherein an inner circumferential portion of each of the plurality of return guide vanes extends up to a position radially inward of an inner end of the annular lower plate portion.

3. The electric blower according to claim 2, wherein the housing case further includes a tubular portion at an inner circumferential portion of the annular lower plate portion to define an exhaust passage between the tubular portion and an outside of the motor; and each of the plurality of return guide vanes includes a portion extending between an inner circumferential surface of the tubular portion and the outside of the motor.

4. electric blower according to claim 3, wherein a junction of the annular lower plate portion and the tubular portion of the housing case includes a smoothly curved inner surface.

5. The electric blower according to claim 4, further comprising flow control vanes each of which is positioned between adjacent ones of the return guide vanes between the inner circumferential surface of the tubular portion and an outer circumferential surface of the motor.

6. The electric blower according to claim 1, wherein the housing case further includes a tubular portion located at an inner circumferential portion of the annular lower plate portion to define an exhaust passage between the tubular portion and an outside of the motor; and each of the plurality of return guide vanes includes a portion extending between an inner circumferential surface of the tubular portion and the outside of the motor.

7. The electric blower according to claim 6, wherein a junction of the annular lower plate portion and the tubular portion of the housing case includes a smoothly curved inner surface.

8. The electric blower according to claim 6, wherein the diffuser further includes an annular inner wall portion located radially inside of the return guide vanes, and including a curved circumferential surface that guides, to the exhaust passage, air which has been guided radially inward by each return guide vane.

9. The electric blower according to claim 6, wherein the diffuser further includes an annular inner wall portion located radially inside of the return guide vanes, and including a curved circumferential surface; and a diameter of a top portion of the diffuser is greater than a diameter of a lower portion of the diffuser.

10. The electric blower according to claim 6, further comprising flow control vanes each of which is located between adjacent ones of the return guide vanes between the inner circumferential surface of the tubular portion and an outer circumferential surface of the motor.

11. The electric blower according to claim 1, wherein each return guide vane bends in a circumferential direction at least above the annular lower plate portion.

12. The electric blower according to claim 1, further comprising an annular portion that joins the return guide vanes to one another at inner ends of the return guide vanes.

* * * * *